United States Patent [19]

DeBaene

[11] Patent Number: 5,038,408

[45] Date of Patent: Aug. 13, 1991

[54] WORK PANTS

[76] Inventor: David N. DeBaene, 285 Hill St. Unit #10, Coventry, R.I. 02816

[21] Appl. No.: 603,557

[22] Filed: Oct. 26, 1990

[51] Int. Cl.[5] ..... A41D 13/00

[52] U.S. Cl. ..... 2/23; 2/51; 2/79; 2/227; 2/267

[58] Field of Search ..... 2/23, 51, 79, 214, 267, 2/227

[56] References Cited

U.S. PATENT DOCUMENTS

| | | | |
|---|---|---|---|
| 727,243 | 5/1903 | White | 2/23 |
| 907,050 | 12/1908 | Hestness | 2/23 |
| 932,990 | 8/1909 | Madill et al. | 2/227 |
| 1,099,875 | 6/1914 | Fuiks | 2/227 |
| 1,195,523 | 8/1916 | Sonnenberg | 2/51 |
| 1,304,613 | 5/1919 | Smedley | 2/227 |
| 1,366,809 | 1/1921 | Kenrick | 2/227 |
| 1,654,452 | 12/1927 | Bradley | 2/23 |
| 2,138,588 | 11/1938 | Wann | 2/227 |
| 2,346,082 | 4/1944 | Riedl | 2/227 |
| 4,282,608 | 8/1981 | Amberg | 2/227 |
| 4,561,124 | 12/1985 | Thompson | 2/227 |
| 4,613,991 | 9/1986 | Grover | 2/227 |
| 4,922,551 | 5/1990 | Anthes | 2/79 |

*Primary Examiner*—Werner H. Schroeder
*Assistant Examiner*—Gloria Hale
*Attorney, Agent, or Firm*—Barlow & Barlow, Ltd.

[57] ABSTRACT

Pants for use when performing work in which sitting and kneeling take place frequently, as in roofing work, the pants having effective special construction in the seat and knee areas.

3 Claims, 1 Drawing Sheet

WORK PANTS

BACKGROUND OF THE INVENTION

There are certain situations in the construction trades in which the worker is subjected to specific abrasions and discomfort to localized portions of his body. This is particularly true in the case of roofing work, because the surface which is being worked on (shingles and roofing boards) is particularly rough in texture and because the work is done while kneeling or sitting on the surface. While it is customary for workers in this trade to wear demin pants or jeans, the abrasion causes the pants to wear rather rapidly, while the demin provides very little protection for the worker's knees. In the past, workers who do a great deal of kneeling (roofers, floor installers, and tile layers) have used rubber pads held on by elastic bands, but these tend to twist, fall down, and to cut off blood circulation.

Attempts have been made over the years to reinforce work pants by attaching patches of various materials. This is shown in the patent of Sheppard U.S. Pat. No. 509,693 (inside of seat of pants), the patent of Smedley U.S. Pat. No. 1,304,613 (layer of cloth inside of knee), the patent of Mock U.S. Pat. No. 1,711,611 (wool liner in seat of pants), the patent of Modesitt U.S. Pat. No. 1,777,620 (canvas patch held by snaps to exterior of knee or seat), and the patent of Atack U.S. Pat. No. 4,035,844 (knee patch sewed in place). Several patents show a pocket located at the knee area with an inserted resilient pad, these being such patents as those to Walker U.S. Pat. No. 2,355,193, to Smith U.S. Pat. No. 3,168,146, to Thompson U.S. Pat. No. 4,861,124, to Grover U.S. Pat. No. 4,613,991 (leather patches), to Denman U.S. Pat. No. 4,831,666, and to White U.S. Pat. No. 727,243. The patent of Carson U.S. Pat. No. 1,293,700 shows knee protectors held in place by straps;, while the patent of Mitchell U.S. Pat. No. 2,568,083 attaches them with zippers and the patent of Herbelin U.S. Pat. No. 588,907 shows the permanent attachment of a pad (which may be hair) held on the pant leg by a hollow casing (which may be leather).

All of these constructions have suffered from various deficiencies, including non-durability, complexity, costly details, and failure to protect the worker adequately. These and other difficulties experienced with the prior art devices have been obviated in a novel manner by the present invention.

It is, therefore, an outstanding object of the invention to provide work pants having a high degree of resistance to wear.

Another object of this invention is the provision of pants for used in roofing work and the like, which pants protect the worker from abrasion and discomfort.

A further object of the present invention is the provision of work pants which are simple and rugged in design, which can be inexpensively manufactured from readily available materials, and which are capable of a long life of useful service with a minimum of maintenance.

A still further object of the invention is the provision of work pants having protective knee pads which dry easily when they become wet.

It is a further object of the invention to provide a pair of pants having wear-resistant panels which are, nevertheless, aesthetically pleasing in appearance.

Another object of the invention is the provision of work pants which are provided with panels that resist sliding when the wearer is working on an inclined surface.

Another object of the invention is the provision of pants having wear resistant and protective panels that are not easily torn.

With these and other objects in view, as will be apparent to those skilled in the art, the invention resides in the combination of parts set forth in the specification and covered by the claims appended hereto.

SUMMARY OF THE INVENTION

In general, the invention has to do with a pair of work pants, having a waist portion including a front panel and a rear panel, and having two leg portions, each of which includes a reinforcing panel in the knee area, the rear panel of the waist portion being formed of a highly wear-resistant sheet material.

More specifically, the reinforcing panel in the knee area consists of a lamination of an inner resilient pad and an outer wear-resistant sheet. The resilient pad is formed of a closed-cell, foamed polymer. The sheet material in the rear panel is leather with the rough unfinished surface facing outwardly. The outer wear-resistant sheet in the knee area is leather with the rough surface facing outwardly.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
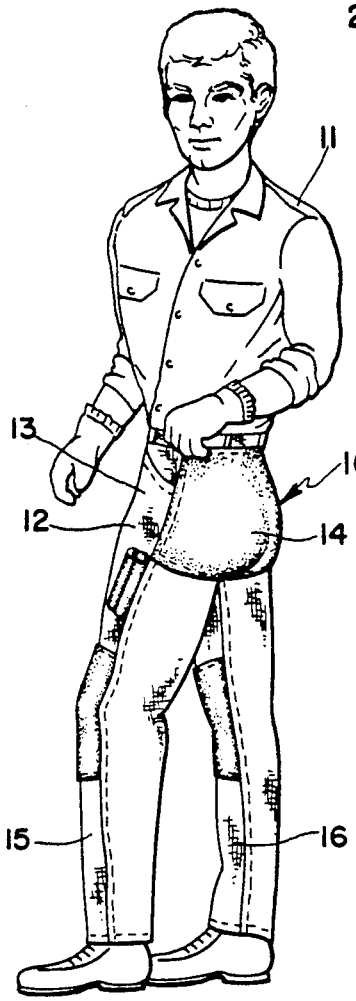
FIG. 1 is a perspective view of a pair of work pants incorporating the principles of the present invention and shown in use on a construction worker.

Referring first to FIG. 1, which best shows the general features of the invention, the pair of work pants, indicated generally by the reference numeral 10, is shown in use by a construction worker 11. The pants are formed with a waist portion 12 which is made up of a front panel 13 and rear panel 14. The pants are also provided with two peg portions 15 and 16 extending downwardly from the waist portion.

Figure 2:
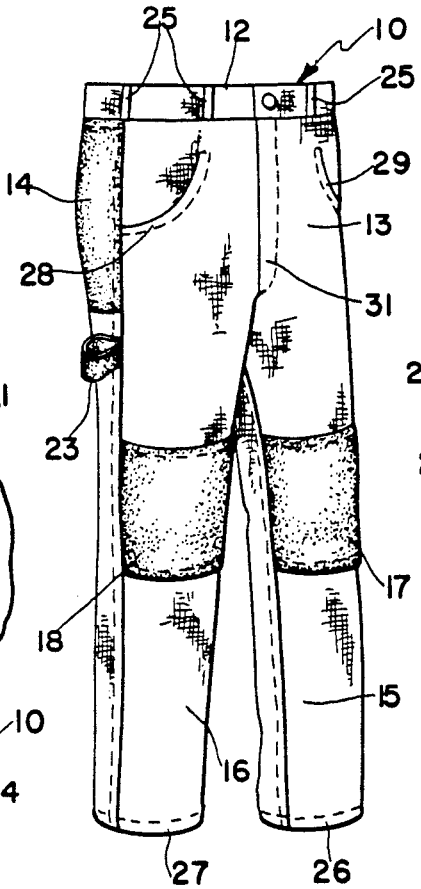
FIG. 2 is a substantially front elevational view of the invention.
Figure 3:
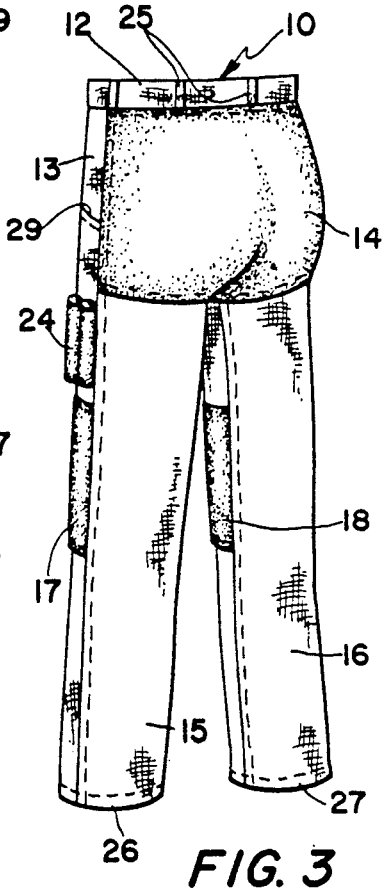
FIG. 3 is a substantially rear elevational view of the invention.

FIGS. 2 and 3 illustrate the details of construction of the work pants 10, including the manner in which the rear panel 14 of the waist portion is formed from a single piece of leather. The rear panel is sewn to and covers the back of the pants. It also extends from one side to the other of the front panel 13. In the preferred embodiment, this rear panel is arranged so that the smooth side of the leather faces inwardly and the rough side faces outwardly. The thickness is selected to give sufficient flexibility to conform to the body of the user, while maintaining adequate stiffness that protrusions, etc., on a surface on which the worker sits are not transmitted through the material to the body of the user.

As is evident from the drawings, the leg portion 15 is provided with a reinforcing panel 17 in the knee area and the leg portion 16 is provided with a similar panel 18. Each panel extends completely across the front of its leg portion from leg seam to leg seam, so that the edges along the seams share in the stitching used to secure the pant material at the seam. There may be double or triple stitching at this point and different types of thread may be used.

Figure 4:
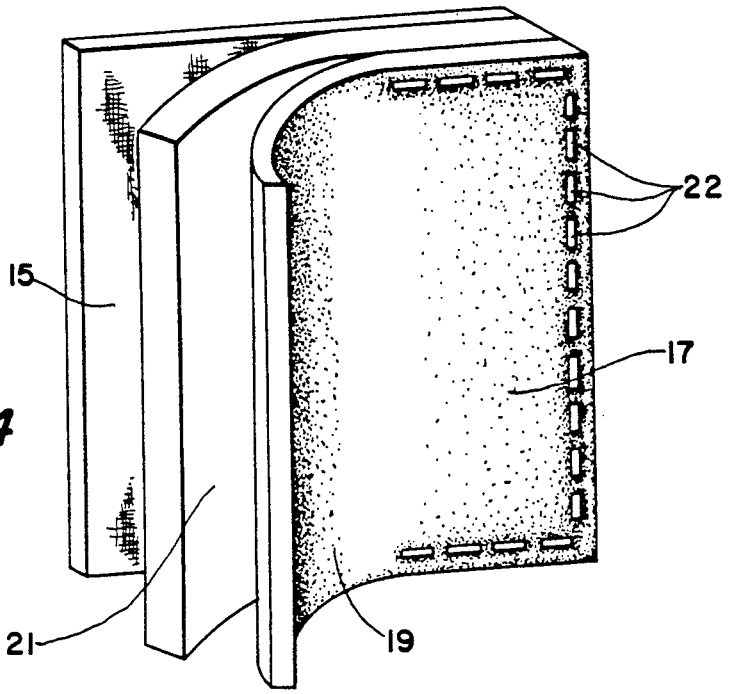
FIG. 4 is a somewhat schematic view of a knee panel forming part of the invention.

The construction of the reinforcing panels is clearly shown in FIG. 4; the panel 17 consists of two layers 19 and 21 which are held by large stitches 22 to the demin making up the front of the leg portion 15. In the preferred embodiment, the outer layer 19 is formed of leather and used in such a way that the smooth surface faces inwardly (in contact with the inner layer 21) and the rough surface faces outwardly. The inner layer 21 is substantially thicker than the outer layer 19 and is formed of a sheet of closed-cell, foamed polymer, such as polyethylene. The closed-cell structure insures that the layer be substantially impermeable, while providing a high degree of resiliency.

As is evident in FIG. 2, which shows the arrangement for a right-handed carpenter, the outer side of the right leg portion 16 is provided with a leather hammer loop 23. In FIG. 3, it can be seen that the outer side of the left leg portion 15 is provided with a leather pocket 24 for pencils. All of the parts of the work pants, except for the rear panel 14 of the waist portion 12, are made of heavy- duty demin, including belt loops 25 at the upper part of the waist portion. It is desirable that the demin material be doubled and sewn at the bottom edges of the leg portions 15 and 16 to form bottom seams 26 and 27, respectively. This same doubling technique is used at the inner and outer longitudinal seams, particularly in the location where the vertical edges of the reinforcing panels 17 and 18 are attached. Similar reinforcing seams are used on slash pockets 28 and 29 and on the fly 31.

The operation and advantages of the present invention will now be readily understood in light of the above description. It is evident that the work pants 10 are particularly useful in the construction work involved with the application of roofing. In this type of work, the worker 11 often kneels and sits while laying tar paper and shingles in place. The rough surfaces of the shingles and roof planks (or plywood) are very uncomfortable and abrasive. Conventional demin jeans quickly wear out under such treatment, thus leading to accentuated discomfort and, ultimately, to destruction of the jeans. It can be seen, then,, that this leads not only to making roofing work uncomfortable, but the expense of frequent replacement of work jeans is appreciable.

When the work pants 10, constructed in accordance with the teachings of the present invention, are used in roofing or similar work, the advantages are quite clear. When the work is done in a seated position on an inclined roof, the rough outer surface of the leather rear panel 14 provides considerable friction to inhibit sliding and, therefore, increases safety. At the same time, the smooth inner surface promotes sliding of the worker's buttocks within the pants, thus contributing to comfort. So, the leather rear panel 14 leads to safety, comfort, and long wear.

When the roofing work involves kneeling on an inclined roof, the rough outer surface of the leather layer 19 of the reinforcing panel 17 increases the safety for the workman, because it provides increased friction, as compared with that provided by unreinforced demin. At the same time, the smooth inner surface of the leather allows sliding between the layer 19 and the resilient inner layer 21, thus facilitating leg movement and knee bending without resistance. Furthermore, in such work it is common for the worker's knee area to become wet, either because of rain or of dew on the roof. The fact that the resilient layer 21 is of closed-cell structure means that such wetness will not be absorbed and, therefore, the combination of demin, closed-cell foamed polymer, and leather at the knee joint will dry quickly. It is clear, then, that the present knee panel construction serves to promote safety, comfort, and long wear.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Work pants, comprising (a) a waistband portion, a front panel and a rear seat portion joined by right and left outer seams, and (b) two leg portions, each of which includes a reinforcing panel in the knee area, wherein the said rear panel of the waist portion is formed of a highly wear-resistant sheet material, the said reinforcing panel in the knee area consists of a lamination of an inner resilient pad and an outer wear-resistant sheet, the resilient pad being formed of a closed-cell foamed polymer, and wherein said sheet material in the rear panel is leather with the rough surface facing outwardly and the smooth surface facing inwardly.

2. Work pants, as recited in claim 1, wherein said outer wear-resistant sheet in the knee area is leather with the rough surface facing outwardly.

3. Work pants, as recited in claim 1, wherein a right leg portion has a hook for holding a hammer along an outer seam, and wherein a left leg portion is provided along an outer seam with a pencil pocket.

* * * * *